US012385333B2

(12) United States Patent
Canizares et al.

(10) Patent No.: US 12,385,333 B2
(45) Date of Patent: Aug. 12, 2025

(54) LOST CIRCULATION MITIGATION

(71) Applicant: Schlumberger Technology Corporation, Sugar Land, TX (US)

(72) Inventors: Priscilla Canizares, Cambridge (GB); Valerian Guillot, Montpellier (FR); Ashley Bernard Johnson, Cambridge (GB)

(73) Assignee: Schlumberger Technology Corporation, Sugar Land, TX (US)

( * ) Notice: Subject to any disclaimer, the term of this patent is extended or adjusted under 35 U.S.C. 154(b) by 393 days.

(21) Appl. No.: 17/662,272

(22) Filed: May 6, 2022

(65) Prior Publication Data

US 2022/0364424 A1 Nov. 17, 2022

Related U.S. Application Data

(60) Provisional application No. 63/184,867, filed on May 6, 2021.

(51) Int. Cl.
*E21B 21/00* (2006.01)

(52) U.S. Cl.
CPC ..... *E21B 21/003* (2013.01)

(58) Field of Classification Search
CPC ..... E21B 21/003; E21B 33/138; E21B 43/26; E21B 33/14; E21B 43/267; E21B 21/08; E21B 47/06; E21B 43/103; E21B 43/10; E21B 49/00; E21B 47/12; E21B 33/01
See application file for complete search history.

(56) References Cited

U.S. PATENT DOCUMENTS

| | | | | |
|---|---|---|---|---|
| 8,672,057 | B2 * | 3/2014 | DuPriest | E21B 21/06 166/292 |
| 9,038,718 | B1 * | 5/2015 | Karimi | E21B 33/138 166/278 |
| 2008/0041149 | A1 * | 2/2008 | Leuchtenberg | E21B 21/08 73/152.21 |
| 2009/0188718 | A1 * | 7/2009 | Kaageson-Loe | E21B 21/003 175/57 |
| 2013/0299241 | A1 * | 11/2013 | Alberty | E21B 47/10 175/50 |
| 2016/0002991 | A1 * | 1/2016 | Rasmus | E21B 49/005 175/25 |

(Continued)

*Primary Examiner* — Eman A Alkafawi
*Assistant Examiner* — Dilara Sultana
(74) *Attorney, Agent, or Firm* — Jeffrey D. Frantz

(57) ABSTRACT

Lost circulation events are mitigated by determining a size and extent of a formation feature causing the loss of circulation. The formation feature may be determined based on surface drilling parameters, and can apply one or more of a mechanical specific energy, hydraulic, or aperture model. Using such model(s), the size of a fracture/void/aperture can be estimated and a treatment plan for a lost circulation vent can be determined. For instance, a mechanical specific energy of zero can indicate the presence of a void, the pressure at the standpipe can an extent of a formation feature, or the size of the formation feature can be estimated using drilling fluid flow rate, volume, pressure, or rheology. Determining a treatment plan can include selecting or designing a lost circulation material, a volume of lost circulation material, or alternative drilling methods.

14 Claims, 8 Drawing Sheets

(56) References Cited

U.S. PATENT DOCUMENTS

| | | | | |
|---|---|---|---|---|
| 2016/0201410 | A1* | 7/2016 | Zhou | E21B 47/00 175/57 |
| 2017/0052272 | A1* | 2/2017 | Maeso | G01V 3/20 |
| 2018/0051528 | A1* | 2/2018 | Ravi | C09K 8/428 |
| 2018/0058992 | A1* | 3/2018 | van Oort | G01N 11/02 |

* cited by examiner

LOST CIRCULATION MITIGATION

CROSS-REFERENCE TO RELATED APPLICATIONS

This application claims the benefit of, and priority to, U.S. Patent Application No. 63/184,867 filed May 6, 2021 and titled "Lost Circulation Mitigation", which application is expressly incorporated herein by this reference in its entirety.

BACKGROUND

Wellbores are often drilled to recover oil, natural gas, and other resources. Drilling fluid is circulated through a wellbore during the drilling process to perform various tasks, such as power generation, lubrication, equipment cooling, cuttings removal, and so forth. Formation features may include fractures and/or voids into which the drilling fluid may flow, thereby causing the drilling fluid to flow into the formation, rather than back to the surface.

SUMMARY

In some embodiments, a method for mitigating a lost circulation event includes receiving a mechanical specific energy for a formation based on an energy used to degrade the formation. A void is identified based on a zone where the mechanical specific energy is zero or approaches zero. The extent of the void is based on a thickness of the zone. A treatment plan for the zone is identified based on the extent of the void.

In some embodiments, a method for mitigating a lost circulation event includes estimating loss noise on a downhole pressure signal of a drilling fluid. The loss noise is compared to a pre-loss signal to identify a lost circulation event. A high viscosity sweep pump is performed, and the pressure spike is tracked. A length of the flow restriction is estimated using a duration of the pressure spike.

In some embodiments, a method for mitigating a lost circulation event includes determining a model fracture aperture based on surface flow rate, drilling fluid volume, drilling fluid pressure, and drilling fluid rheology. Based on the determined model fracture aperture, a recommendation of a lost circulation material may be made.

This summary is provided to introduce a selection of concepts that are further described in the detailed description. This summary is not intended to identify key or essential features of the claimed subject matter, nor is it intended to be used as an aid in limiting the scope of the claimed subject matter. Additional features and aspects of embodiments of the disclosure will be set forth herein, and in part will be obvious from the description, or may be learned by the practice of such embodiments.

BRIEF DESCRIPTION OF THE DRAWINGS

In order to describe the manner in which the above-recited and other features of the disclosure can be obtained, a more particular description will be rendered by reference to specific embodiments thereof which are illustrated in the appended drawings. For better understanding, the like elements have been designated by like reference numbers throughout the various accompanying figures. While some of the drawings may be schematic or exaggerated representations of concepts, at least some of the drawings may be drawn to scale. Understanding that the drawings depict some example embodiments, the embodiments will be described and explained with additional specificity and detail through the use of the accompanying drawings in which:

FIG. 13-1 through FIG. 13-5 are representations of the volume of an LCM product versus fracture diameter, according to at least one embodiment of the present disclosure.

DETAILED DESCRIPTION

This disclosure generally relates to devices, systems, and methods for mitigating lost circulation (LC) events. Natural formation features are amongst the leading causes of lost circulation during drilling. LC events may increase the time and/or cost to drill a wellbore. To mitigate and even "cure" losses, loss circulation materials (LCM) may be applied. However, LCMs may have limited utility based on limited knowledge of the formation properties resulting in the LC event. This may result in a trial and error process to determine the appropriate LCM. Embodiments of the present disclosure determine whether a formation feature is treatable using LCMs and/or a change in drilling parameters and recommends an efficient LCM from a selection of products, thereby reducing the downtime, or even loss, of a wellbore due to an LC event and/or the reducing the mitigation cost of an LC event.

In some embodiments, when drilling through the formation, extracting the rock out of the formation may involve an amount of energy that is dependent on the geomechanical properties of the formation. That energy is estimated by the mechanical specific energy. When the mechanical specific energy close to the bit drops to zero (e.g., the mechanical specific energy is null) or approaches zero, then the formation may include a void or other LC formation feature (such as a karst). In some embodiments, the thickness of the interval of zero or near-zero mechanical specific energy may help determine the treatability of the lost circulation events. A large interval may be representative of a LC event that is difficult to treat. Based on the length of the interval, a treatment plan may be developed, including the use of LCM and/or cementing and blind drilling of the formation feature.

Figure 1:
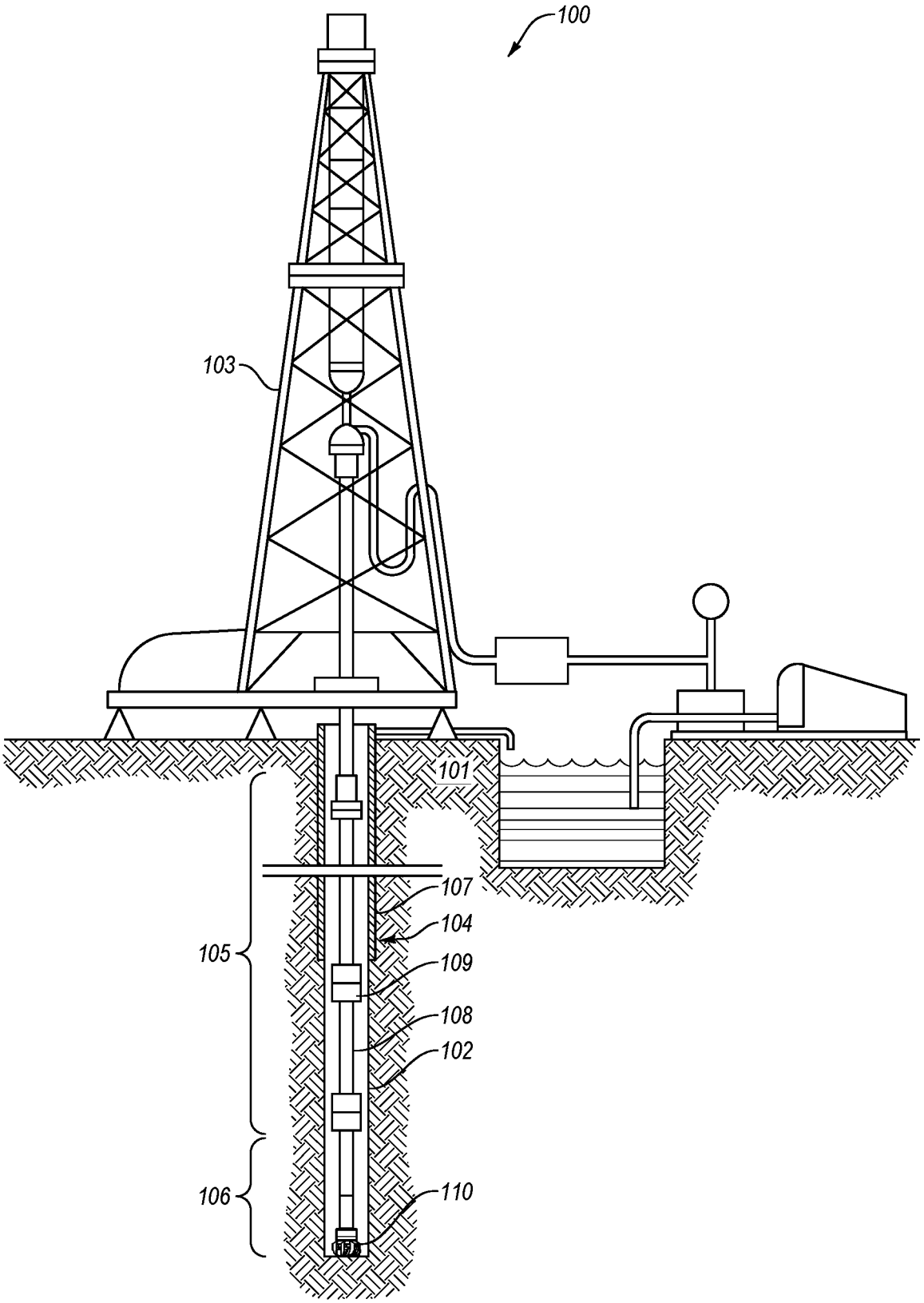
FIG. 1 is a representation of a downhole drilling system, according to at least one embodiment of the present disclosure.

In some embodiments, fluid losses may be caused by natural fractures in the formation. Loss of drilling fluid circulation can result in dangerous well control problems and/or loss of the well, with costly and time-consuming consequences. An effective loss zone aperture may be a representation of the size of the fractures in the formation. The effective loss zone aperture may be used to recommend an LCM. This may help to timely cure and control LC events. To determine the effective loss zone aperture, the geometry of natural fractures from drilling information may be inferred from flow rate, mud loss and differential pressure, drilling fluid properties, and combinations thereof. A recommendation on the most efficient LCM treatment to treat and mitigate the loss may be provided. The recommendation may further include a range of drilling working parameters to increase well integrity, such as target flow rate and pressure. In some embodiments, utilizing first principles and closed-form expressions may allow for quick inference of fluid losses from limited well data FIG. 1 shows one example of a drilling system 100 for drilling an earth formation 101 to form a wellbore 102. The drilling system 100 includes a drill rig 103 used to turn a drilling tool assembly 104 which extends downward into the wellbore 102. The drilling tool assembly 104 may include a drill string 105, a bottomhole assembly (BHA) 106, and a bit 110, attached to the downhole end of drill string 105.

The drill string 105 may include several joints of drill pipe 108 connected end-to-end through tool joints 109. The drill string 105 transmits drilling fluid through a central bore and transmits rotational power from the drill rig 103 to the BHA 106. In some embodiments, the drill string 105 may further include additional components such as subs, pup joints, etc. The drill pipe 108 provides a hydraulic passage through which drilling fluid is pumped from the surface. The drilling fluid discharges through selected-size nozzles, jets, or other orifices in the bit 110 for the purposes of cooling the bit 110 and cutting structures thereon, and for lifting cuttings out of the wellbore 102 as it is being drilled.

As the bit 110 drills through the formation 110, the bit 110 may encounter one or more voids, karsts, fractures, or other formation features that may cause a reduction and/or loss in circulation of the drilling fluid. A reduction or loss of drilling fluid circulation may result in a reduction of effectiveness of the bit 110. In some situations, a reduction or loss of drilling fluid circulation may cause the well to be abandoned. In some situations, LCMs may be implemented to fill the formation features or otherwise stop or prevent the reduction and/or loss in circulation.

In accordance with embodiments of the present disclosure, the reduction or loss in circulation may be identified during drilling operations. Identifying the loss of circulation may allow for LCMs to be implemented earlier. This may increase the effectiveness of the LCMs, thereby reducing the cost and/or time used to restore circulation. In some embodiments, the loss of circulation may be identified using the mechanical specific energy, the change in fluid flow rate, the effective loss zone aperture, and combinations thereof. This may allow the system to provide recommendations of particular LCMs or other circulation restoration mechanisms.

The BHA 106 may include the bit 110 or other components. An example BHA 106 may include additional or other components (e.g., coupled between to the drill string 105 and the bit 110). Examples of additional BHA components include drill collars, stabilizers, measurement-while-drilling (MWD) tools, logging-while-drilling (LWD) tools, downhole motors, underreamers, section mills, hydraulic disconnects, jars, vibration or dampening tools, other components, or combinations of the foregoing. The BHA 106 may further include a rotary steerable system (RSS). The RSS may include directional drilling tools that change a direction of the bit 110, and thereby the trajectory of the wellbore. At least a portion of the RSS may maintain a geostationary position relative to an absolute reference frame, such as gravity, magnetic north, and/or true north. Using measurements obtained with the geostationary position, the RSS may locate the bit 110, change the course of the bit 110, and direct the directional drilling tools on a projected trajectory.

In general, the drilling system 100 may include other drilling components and accessories, such as special valves (e.g., kelly cocks, blowout preventers, and safety valves). Additional components included in the drilling system 100 may be considered a part of the drilling tool assembly 104, the drill string 105, or a part of the BHA 106 depending on their locations in the drilling system 100.

The bit 110 in the BHA 106 may be any type of bit suitable for degrading downhole materials. For instance, the bit 110 may be a drill bit suitable for drilling the earth formation 101. Example types of drill bits used for drilling earth formations are fixed-cutter or drag bits. In other embodiments, the bit 110 may be a mill used for removing metal, composite, elastomer, other materials downhole, or combinations thereof. For instance, the bit 110 may be used with a whipstock to mill into casing 107 lining the wellbore 102. The bit 110 may also be a junk mill used to mill away tools, plugs, cement, other materials within the wellbore 102, or combinations thereof. Swarf or other cuttings formed by use of a mill may be lifted to surface, or may be allowed to fall downhole.

Total mud lost circulation events in oil and gas reservoirs often occur when the wellbore intersects large open fractures or vugular caverns. A trial and error approach to applying LCMs to restore mud circulation results in numerous LCM treatments may not cure the LC event. In some situations, large aperture fractures or caverns may not be plugged using any LCM and may use a different lost circulation mitigation technique, such as pressurized mud cap drilling, sidetracking, cementing casing, casing drilling, liner drilling, managed pressure drilling, plugging, any other mitigation technique, and combinations thereof.

In some embodiments, determining the effective fracture and/or cavern width or diameter that is resulting in the total mud losses may allow a drilling operator to avoid preparing and pumping ineffective LCM treatments. In some embodiments, the fracture aperture diameter may be used to select the appropriate LC mitigation technique. If LCMs are the appropriate LC mitigation technique, the effective diameter may be further used to formulate the most effective LCM recipe and determine the proper volume of LCM to pump in order to plug the fracture/cavern and restore mud circulation.

In some embodiments, a LC mitigation system may process some form of rig data time series to generate a LC mitigation technique. The result from the LC mitigation system is then further used to make a decision or as input into an LCM treatment design. In some embodiments, the LC mitigation system may implement one or more processes to determine the type and/or extent of the LC event.

Bit Drop—Mechanical Specific Energy

In some embodiments, the LC mitigation system may determine a mechanical specific energy. The mechanical specific energy is computed from the weight on bit, rate of penetration, rpm, and torque. Then a machine learning algorithm processes resulting MSE time series pattern to indicate whether the formation currently being drilled contains caverns and open fractures or not.

In some embodiments, the LC mitigation system may determine the standpipe pressure transient. The standpipe pressure transient analysis is computed from a simple mud hydraulic model to interpret changes in the standpipe pressure. When applied before, during and after a total lost circulation event, the LC mitigation system may estimate the apparent hydraulic radius of the cavern or fracture that is causing total lost circulation.

In some embodiments, the LC mitigation system implements an aperture model. The aperture model utilizes mud rheology, estimated mud overpressure (or ECD) during total lost circulation, the mud loss flow rate, and the total mud volume lost to estimate the apparent hydraulic radius of the cavern or fracture causing total lost circulation. In some embodiments, the aperture model may perform a force balance to determine how much of an LCM is required to be pumped into the fracture and/or cavern in order to restore circulation. The force balance uses the LCM yield stress, the desired overpressure to restore circulation, and the apparent hydraulic radius of the fracture and/or cavern determined in the previous step or from the Standpipe pressure transient analysis concept.

Hydraulics Model—Standpipe Pressure Transient

Catastrophic and total losses have been a significant challenge while drilling in some formations. The impact on the operation in terms of the drilling rate, the actual cost of lost fluids, and lost and damaged drilling tools may be high. In some situations, the loss zones may not be traditional fractures that will propagate as fluid flows from the well. In some situations, the loss zones may be flow conduits through which fluid will flow at a relatively high rate (>300 gpm) with a minimal pressure drop (<25 psi).

In accordance with one or more embodiments of the present disclosure, an LC mitigation system may characterize the loss zone such that the system may recommend a treatment path using available data of the measured bottom hole pressure which has been shifted by a fixed but unknown parameter, surface data, depths, standpipe pressure, mud flow rate, and torque. In some embodiments, a transient flow model of the system may be used in the interpretation. In some embodiments, the flow down the loss conduit may be turbulent rather than laminar.

In the period of conventional drilling with full returns to surface the down hole annular pressure, $P_{AP}$, measured at the pressure transducer in the BHA, can be written as:

$$P_{AP}=\rho_{mud}gh_{TVD}+\Delta P_{frict\ T\ S} \tag{1}$$

where $h_{TVD}$ applies to the transducer and $\Delta P_{frict\ T\ S}$ is the frictional pressure drop between the transducer and the surface, which can be written as:

$$\Delta P_{frict\ T\ S} = f\frac{1}{2}\rho\left(\frac{Q_{pump}}{A_{ann}}\right)^2 4\frac{h_{MD}}{D_{hole}-D_{drill\ pipe}} \tag{2}$$

After the loss event the depth of the fluid level in the annulus, $h_{mc\ TVD}$ and $h_{mc\ MD}$ are introduced, and the mud map flow rate is introduced at the top of the annulus $Q_{mc}$.

For the period of total losses at location lz in the well:

$$P_{AP}=\rho_{mud}g(h_{TVD}-h_{mc\ TVD})+\Delta P_{frict\ T\ MC} \tag{3}$$

If the transducer is above the loss zone:

$$P_{frict\ T\ MC} = -f\frac{1}{2}\rho\left(\frac{Q_{mc}+A_{ann}\frac{Dh_{mcMD}}{dt}}{A_{ann}}\right)^2 4\frac{h_{MD}-h_{mc}}{D_{hole}-D_{drill\ pipe}} \tag{4}$$

Note the change of sign due to the reversal of flow direction. But if it is below the loss zone (in a horizontal well).

$$P_{frict\ T\ MC} = -f\frac{1}{2}\rho\left(\frac{Q_{mc}+A_{ann}\frac{Dh_{mcMD}}{dt}}{A_{ann}}\right)^2 4\frac{h_{lz}-h_{mc}}{D_{hole}-D_{drill\ pipe}} + f\frac{1}{2}\rho\left(\frac{Q_{pump}}{A_{ann}}\right)^2 4\frac{h_{MD}-h_{iz\ MD}}{D_{hole}-D_{drill\ pipe}} \tag{5}$$

Also:

$$P_{AP} = P_F + \Delta P_{frict\ T\ LZ} + f\frac{1}{2}\rho\left(\frac{Q_{pump}+Q_{mc}+A_{ann}\frac{dh_{mcMD}}{dt}}{A_{frac}}\right)^2 4\frac{l_{frac}}{D_{frac}} \tag{6}$$

where $P_F$ is the pressure at the far end of the loss conduit, $l_{frac}$ and $D_{frac}$ are the (nominal) length and diameter of the conduit. $\Delta P_{frict\ TLC}$ is the annulus friction between the transducer and the loss zone. The flow rate in this parameter is dependent upon if it is above or below the loss zone. Equations (5) and (6) may be solved with closure from a Non Newtonian hydraulics model. For ease of calculation, a simple hydraulics model may be implemented to build a concept model to characterize the flow in the three legs of the system. The LC mitigation system utilizes either laminar or turbulent model, dependent on Reynolds number, whichever is larger.

$$f = \frac{16}{\mathrm{Re}} \tag{7}$$

$$f = 0.079(\mathrm{Re})^{-0.25} \tag{8}$$

Other models include:

Herschel Buckley Rheology Model $$\tau=\tau_0+k\dot{\gamma}^n \tag{9}$$

for pipe $$\mathrm{Re} = \frac{\rho v D}{\mu_{eff}} \tag{10}$$

for annulus $$\mathrm{Re} = \frac{\rho v (D_0 - D_i)}{\mu_{eff}} \tag{11}$$

and $$\mu_{eff} = \frac{\tau_0}{\dot{\gamma}_{eff}} + k\dot{\gamma}_{eff}^{n-1} \tag{12}$$

for pipe $$\dot{\gamma}_{eff} = \frac{6v}{D} \tag{13}$$

for annulus $$\dot{\gamma}_{eff} = \frac{8v}{D_0 - D_i} \tag{14}$$

Figure 2:
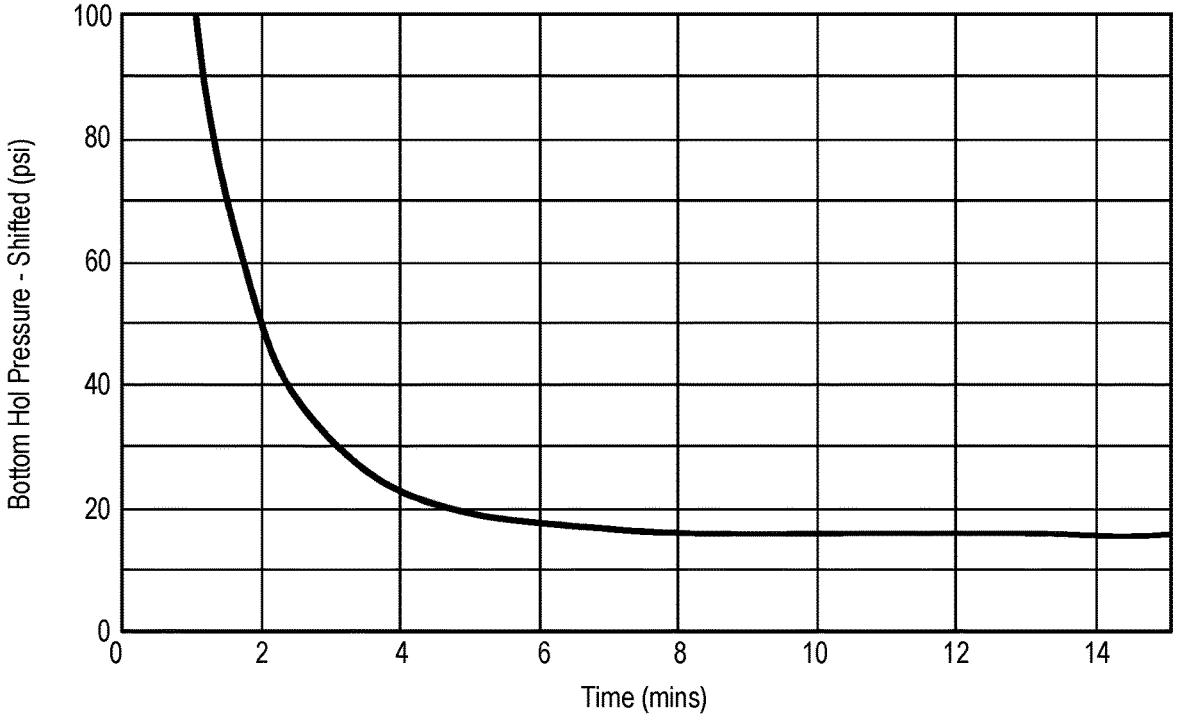
FIG. 2 is a representation of a model downhole pressure change following an initial total loss event, according to at least one embodiment of the present disclosure.
Figure 3:
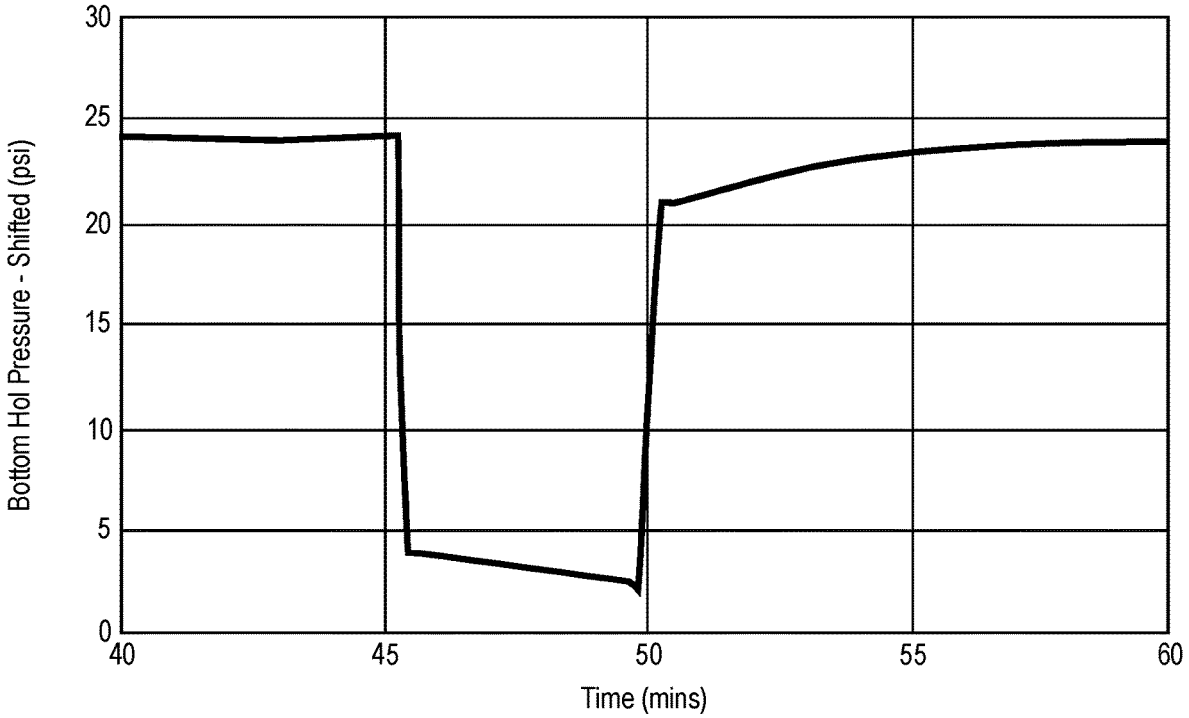
FIG. 3 is a representation of a model pressure change through a connection, according to at least one embodiment of the present disclosure.

For stability and reliability, the LC mitigation system uses the effective shear rate from the section velocity in the previous time step. The data from the model is shifted in a similar manner to the recorded downhole data. For the sample conditions outlined in Table 1, the predictions of the model for the initial loss as well as for a connection is shown in FIG. 2 and FIG. 3.

TABLE 1

| Model Simulation Parameters | |
|---|---|
| Drilling mud flow rate | 275 gpm |
| Mud cap flow rate | 60 gpm |
| Flow conduit restriction | 1.75 in. |
| Flow restriction length | 5 ft. |
| Drilling mud density | 8.4 ppg |
| Drilling mud $\tau_0$ | 1.92 Pa |
| Drilling mud k | 0.069 |
| Drilling mud n | 0.67 |
| Mud cap mud density | 10.9 ppg |
| Mud cap mud $\tau_0$ | 3.37 Pa |
| Mud cap mud k | 0.28 |
| Mud cap mud n | 0.6 |

The model prediction for the drop in pressure in the initial loss event may be characteristic of the actual wellbore conditions. The initial rapid drop may be missed in the model but the tail as the fluid drains into the loss conduit may be well captured. In some embodiments, missing the initial drop may be due to inaccuracies in the Non-Newtonian fluid representation of the fluid in the annulus.

Figure 4:
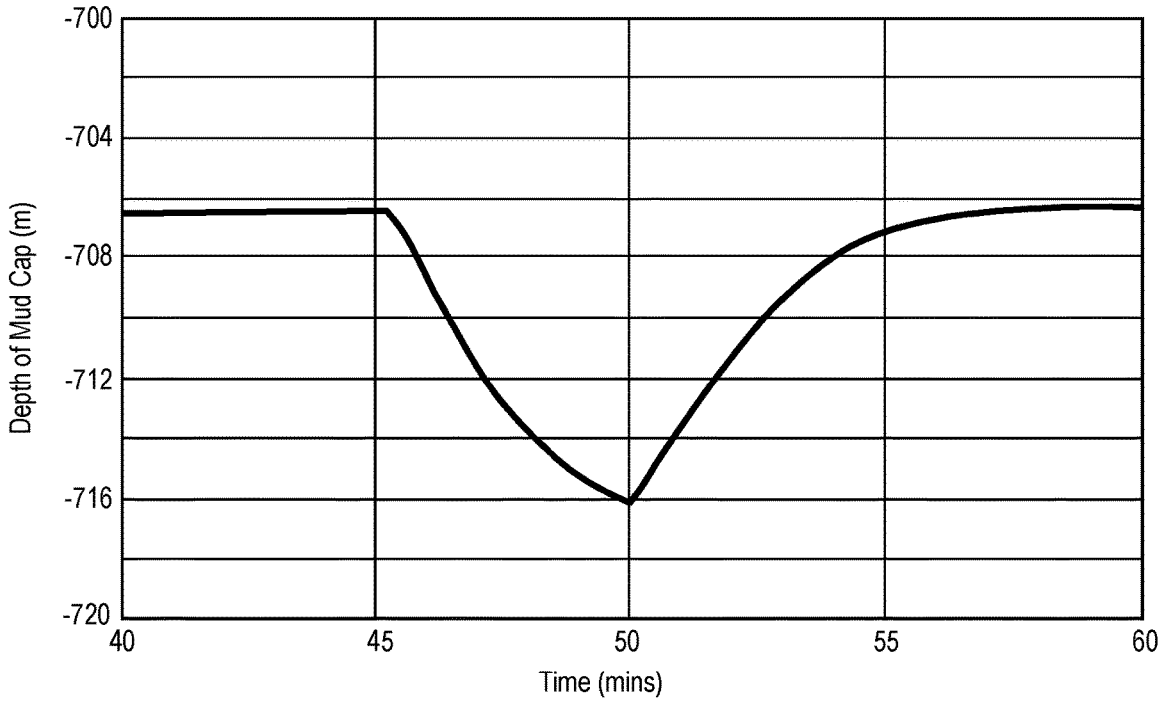
FIG. 4 is a representation of a model change in depth of the mud cap through a connection, according to at least one embodiment of the present disclosure.

FIG. 3 and FIG. 4 provide a simulation of the connection. All aspects of the pressure changes may be captured. This is important as it will enable the model to be used to look at sensitivity to changes in the fluid loss conduit. It is noteworthy that the drop in the mud cap level is very slow, significantly slower than the drop in down hole annular pressure. This may be due to the relatively higher friction in the annulus compared to the loss conduit, so the fluid can flow rapidly into the loss conduit but is slowed by the flow down the annulus.

Figure 5:
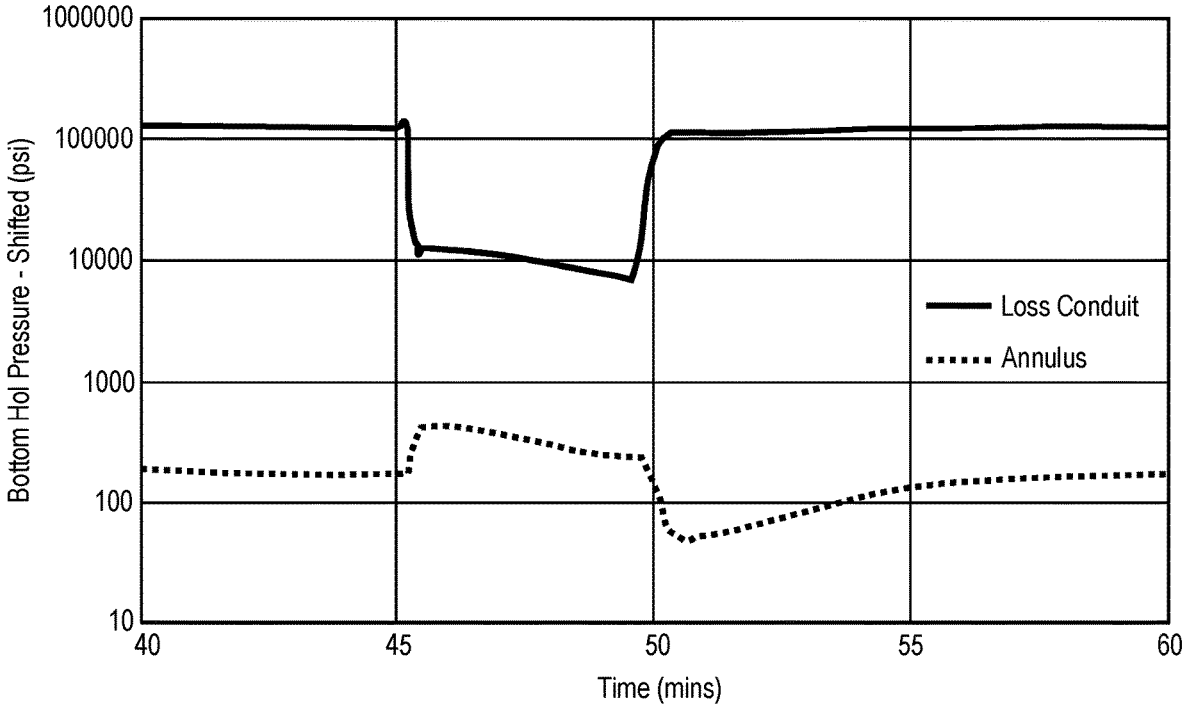
FIG. 5 is a representation of the Reynolds number for the flow in the loss conduit and in the annulus during a connection, according to at least one embodiment of the present disclosure.

For completeness the Reynolds Number for the flow in the loss conduit and the wellbore annulus is shown over a connection in FIG. 5. It is evident that although the flow in the annulus is laminar, in the loss conduit it is almost certainly turbulent.

Figure 6:
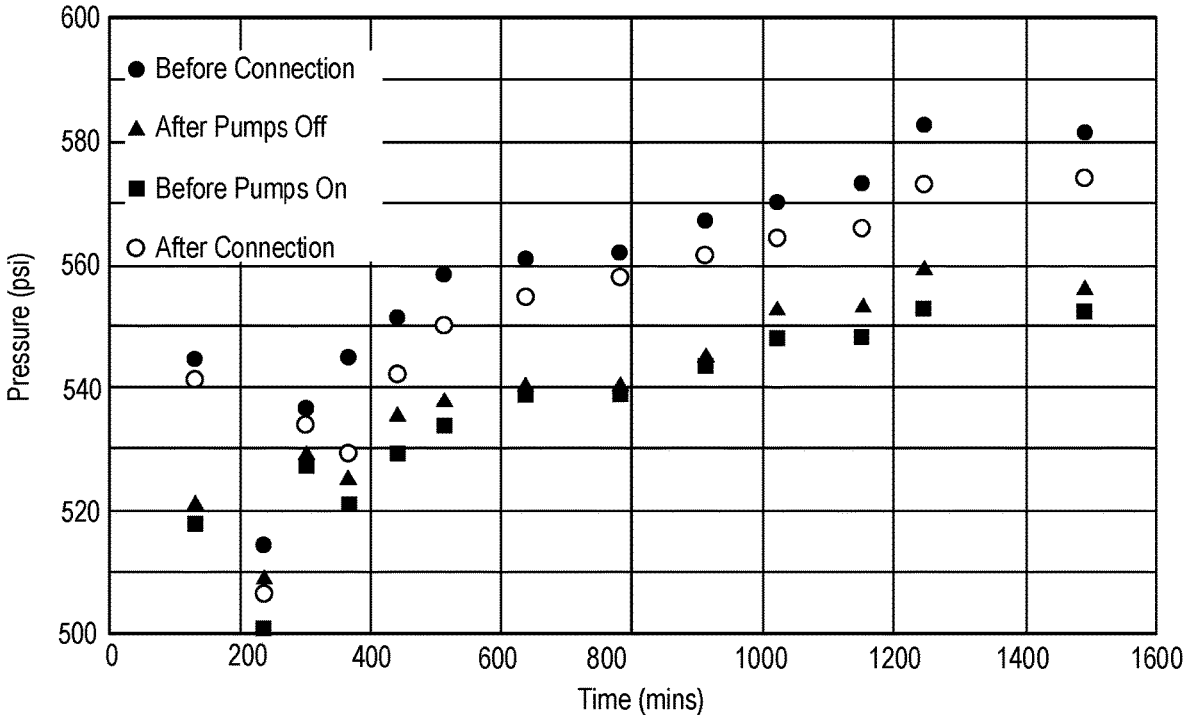
FIG. 6 is a representation of pressure levels from a downhole pressure gauge before and after the pumps turn off and on, according to at least one embodiment of the present disclosure.
Figure 7:
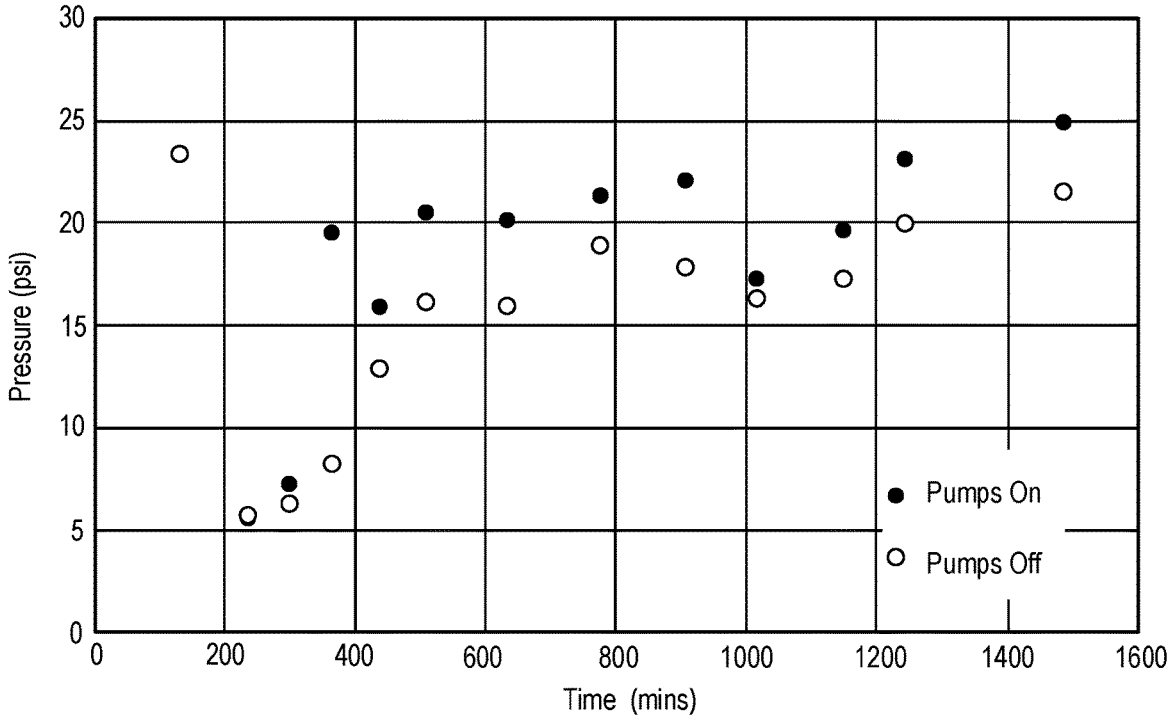
FIG. 7 is a representation of downhole pressure drop and increase when the pumps are turned off and back on again for each connection, according to at least one embodiment of the present disclosure.
Figure 8:
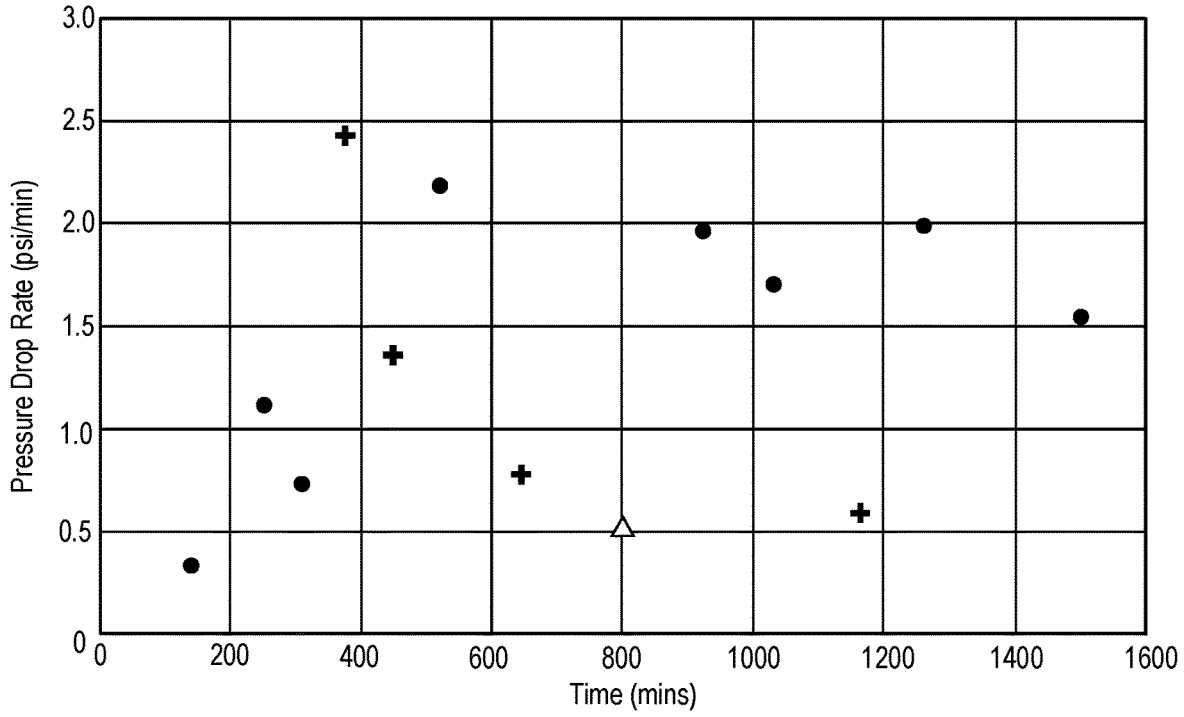
FIG. 8 is a representation of the rate of drop in downhole annular pressure during connection and the slope of the line between the standpipe pressure measured before pumps are turned off and immediately after the pressure recovers, according to at least one embodiment of the present disclosure.

Actual wellbore data harvested from the connections is shown in FIG. 6, FIG. 7, and FIG. 8 for the actual pressures, the rapid change in pressure with pumps going off, and on and the rate of pressure change through the connection, respectively.

Over the period of blind drilling the absolute pressure level through the connections drops initially (to the connection at about 330 minutes) then recovers, as may be seen in FIG. 6. In some embodiments, this may follow the same trend as has been discussed above. The drop may be attributed to opening up new conduits for flow loss while the pressure rise due to the increased annular friction as well as some pressure recovery. Looking at the data for the pressure changes when the pumps are stopped and restarted, as may be seen in FIG. 7, a similar trend emerges. The change in pressure with the change in flow is dominated by the change in friction, in both the annulus and the loss conduit. The drop in pressure up to 200 minutes the change with flow almost matches the absolute pressure change, indicating that this is due to new flow paths opening. The rise up to about 500 minutes is dominated by the dynamic pressure change, however beyond this time the recovery is led by the far field pressure change.

An initial analysis of the connection data indicated a slow drop in the down hole pressure after the flow from the pumps had ceased. This may also be seen in the predictions from the model (see above). This may be the result of the fluid level in the annulus dropping as more fluid drains into the loss zone, as may be seen in FIG. 8. In some embodiments, the trend of this rate of pressure loss may correlate with the pressure recovery seen in the other measurements. It is not to say that this should be used as an alternative to the pumps measure but it is supporting material.

Figure 9:
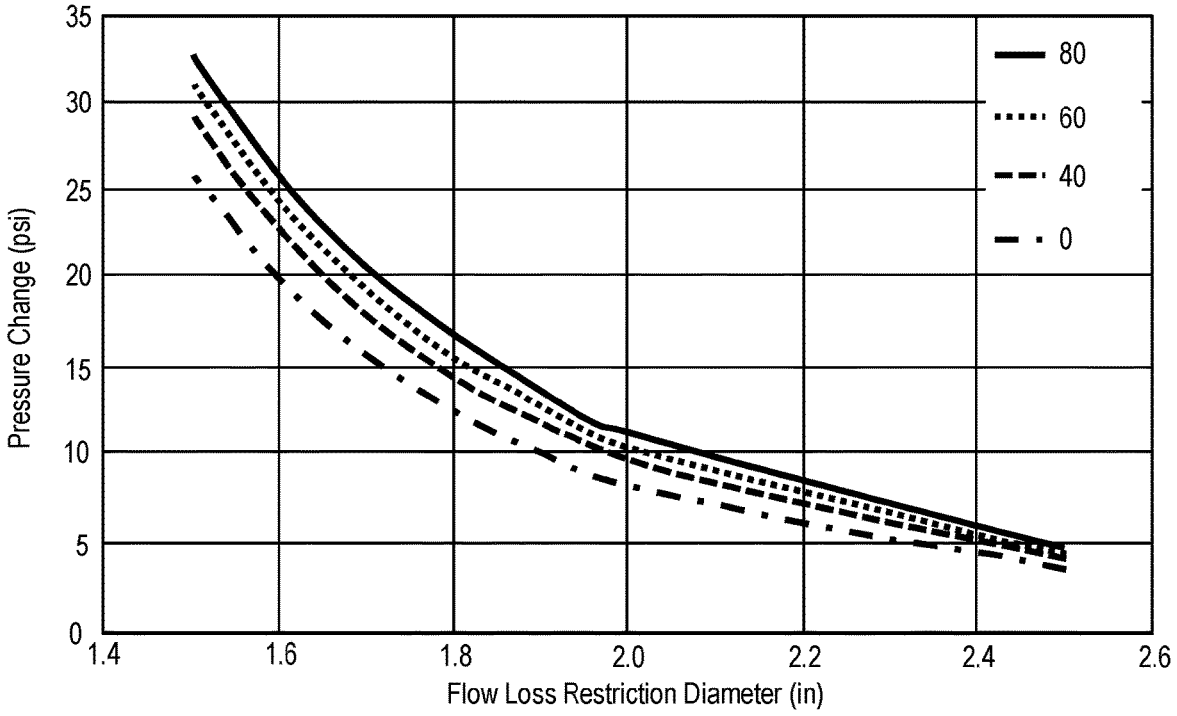
FIG. 9 is a representation of the predicted downhole annular pressure drop when the pumps are turned off, according to at least one embodiment of the present disclosure.
Figure 10:
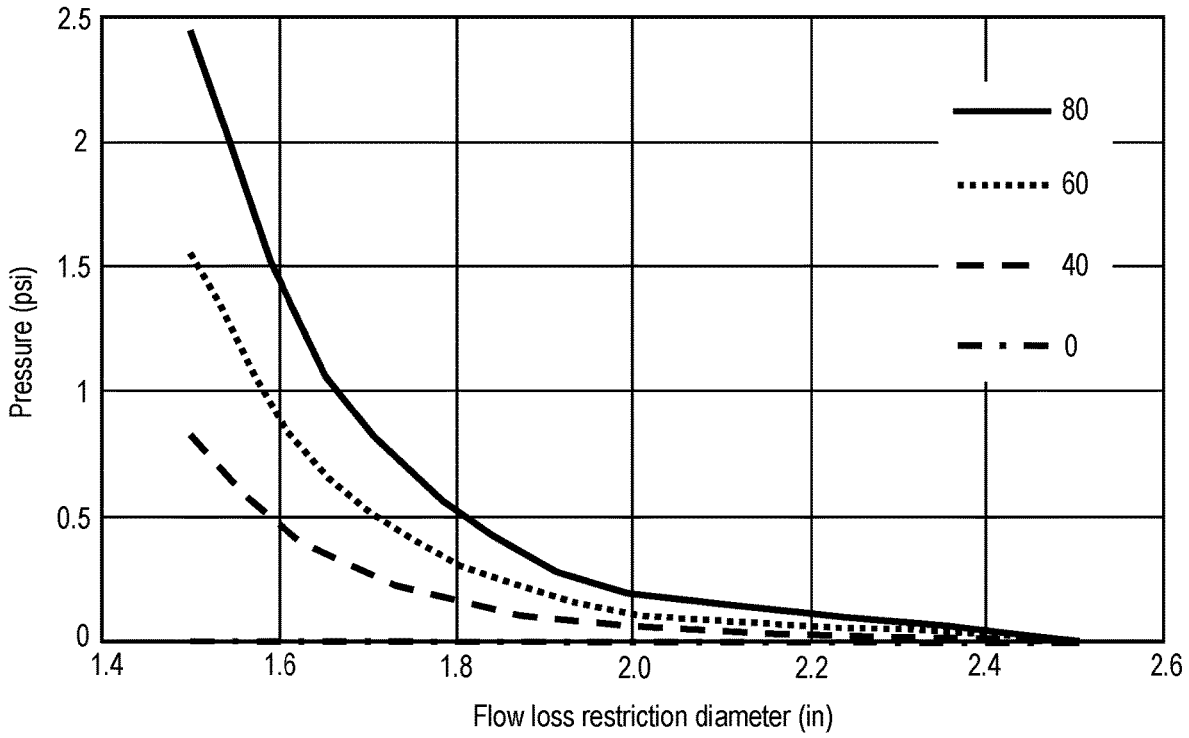
FIG. 10 is a representation of the predicted downhole pressure drop when the pumps are turned off during a connection, according to at least one embodiment of the present disclosure.
Figure 11:
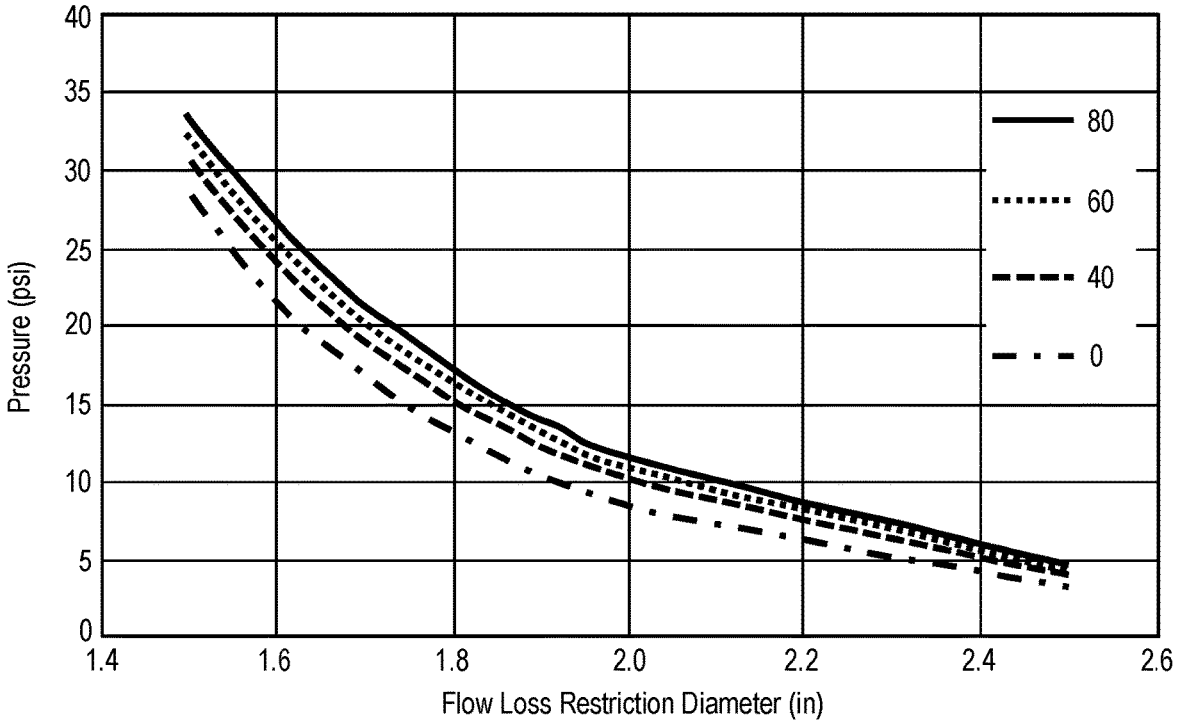
FIG. 11 is a representation of the predicted downhole pressure drop when the pumps are turned on, according to at least one embodiment of the present disclosure.

As this pressure rate is dependent on the flow of mud down the annulus used the model to evaluate the effect the mud cap flow rate would have. FIGS. 9, 10, and 11 show predictions of the pressure changes from the model as a function of the flow conduit restriction diameter and the mud cap fluid injection rate.

In FIG. 9 the predictions for the effect of the pumps going off and on show, as expected, a strong correlation to the flow restriction and a weaker, but significant, sensitivity to the mud cap injection rate. In some embodiments, this may be relevant when interpreting the pressure steps as the mud cap injection is not constant and is very variable. The predictions for the pressure drop while the pumps are off still show a sensitivity to the geometry of the fluid loss conduit. However, they also show a comparable sensitivity to the mud cap injection rate.

In FIG. 10, the standpipe pressure data from prior to the pumps going off to the moment the pressure levels after restart are used to provide an estimate for the drop in the mud cap through the time of the connection.

In some embodiments, the LC mitigation system may include a method to design an optimized operational strategy to complete a wellbore. The method may include options such as LCMs, blind drilling, plugging, sidetracking, casing drilling, liner drilling, managed pressure drilling, any other LC mitigation technique, and combinations thereof. In some embodiments, the method may include reconfiguring MWD frames to raise priority for downhole annular pressure transmission (this would include the MWD frame to have been previously configured). The method may further include estimating and tracking noise on down hole pressure signal, comparing to noise before losses and continuing with this through the drilling period. The system may verify synchronization of down hole and surface pressures, using connections and pressure drop when losses occurred.

In some embodiments, when a first high viscosity (HIV) sweep is pumped, the system may track pressure spike through bit (from standpipe pressure) and when entering formation. The relative duration of the pressure spike may then be used to estimate the length of flow restriction in formation. The system may wait for connection data or make a pump stop and restart event with −3 minutes pumps off time. The system may then use the pump off and restart pressure changes with a dynamics model (which may be an estimate of restriction length from above) to characterize the flow restriction. The estimate from the model may be a (nominal) restriction diameter. This characterization of the loss conduit may then be used to compared to offset well data in the selection of best treatment recommendation. The system may continue to track downhole parameters, including: absolute downhole pressure level while circulating drilling fluid, downhole pressure noise, pressure drop and recovery during connections, the amplitude of the pressure spike when HV sweeps are pumped into a formation, any other parameter, and combinations thereof.

In summary, the loss conduit may be characterized using several techniques, including identifying a difference in downhole pressure levels during a connection prior to losses. The pressure level while circulating and the level after losses shows the pressure recovery that may be used for initial and/or full returns. Pressure spikes characterized by a viscous sweep goes through the bit and into the formation may indicate the loss characteristic as well as the length of the flow restriction. Absolute bottom hole pressure changes during the blind drilling period may track changes in the flow restriction or far field pressures. A drop in down hole pressure when the pumps are turned off for a connection can elucidate the size of the flow restriction, combined with the absolute pressure can show if recovery is in far field pressure or in blocking path. A pressure rise when pumps are restarted shows similar information as pumps off data. A change in down hole pressure when the pumps are off can show an evolution in flow restriction. A change in level of the standpipe pressure from level prior to pumps off for a connection and the initial level after pumps restart gives qualitative description of the flow restriction. A change in the noise on the down hole pressure signal may provide a qualitive characterization of the local flow restriction Aperture Model In some embodiments, the laminar and established flow of non-Newtonian fluid in a cylindrical pipe may be considered a representation of the natural loss mechanism. This mathematical idealization has the advantage of making the problem mathematically tractable and, in principle, easy to verify the results with experimental data.

The fluid's rheology may account for its behavior inside the fracture (conduit) in response to drilling parameters, such as flow rate and pressure. In this work drilling fluids and LCM gels follow a Hershel-Bulkley (HB) model. HB fluids in a pipe present a core in the center that behaves as a solid and gives rise to a flat central section in the velocity profile. This behavior is due to the apparent molecular viscosity, which has a minimum at the pipe wall (where the velocity gradient is the steepest) and increases to infinity in the central un-yielded core. With increasing flow rate and turbulence, the central core diminishes, and the flow increasingly behaves like turbulent Newtonian flow. But, under some flow conditions, turbulence may be suppressed entirely. However, unlike turbulent Newtonian flows, there is no region where viscous effects are negligible during turbulence in a HB fluid.

The dual character of HB fluids poses challenges when performing numerical simulations because the flow around the center is characterized as a plug region and near the wall as non-plug flow. For example, for Newtonian fluids in a pipe, the laminar-turbulent transition point can be defined in terms of the Reynolds number: turbulence occurs when the molecular viscosity is overtaken by the turbulent eddy viscosity over the majority of the pipe cross-section. However, for a yield stress fluid, like HB, there is no unique definition of the Reynolds number.

In some embodiments, developing an LCM recommendation system using minimal assumptions may increase the timeliness of treatment treat these massive losses. In some embodiments, a timely LCM recommendation system may be based on solving the flow equation for non-Newtonian fluids in horizontal pipes. To estimate the fracture's aperture, the equation is solved numerically, for a given flow-rate, fluid volume, pressure and fluid rheology.

In some embodiments, an LCM model may timely determine the fracture aperture using closed-form equations. The inferred aperture is, then, used to estimate the volume of LCM product we needed to pump to "plug the fracture," or fill the fractures to reduce the amount of lost drilling fluid. Note that the fluid rheology of the drilling fluid used in determining the aperture may be generally different from the rheology of the LCM.

In general, the HB rheological model is introduced in the following form:

$$\begin{cases} |\tau| = \tau_0 + K\dot{\gamma}^n & \text{if } |\tau| > \tau_0 \\ \dot{\gamma} = 0 & \text{otherwise} \end{cases} \tag{15}$$

where $\gamma = dv/dr$ is the rate of shear of the fluid (entirely dependent of the fluid properties), with dv/dr the radial derivative of the velocity of the liquid and to is the yield shear stress. K is the consistency index, which determines how viscous the fluid is when flowing. And n is the flow behavior index (n=1 for Newtonian fluids, n<1 for pseudoplastic fluids and n>1 for dilatant fluids).

In some embodiments, a bi-viscosity representation (described below in Eq. (16)) incorporates the dual character of HB fluids and serves as a stepping stone to derive a functional form between drilling parameters, like: flow rate, fluid rheology and differential pressure, and the radius of the pipe (i.e. the fracture aperture).

The bi-viscosity model is a regularization of the HB model into two viscosities, namely: Newtonian, in case $|\tau|<\tau_m$ and HB for $|\tau|<\tau_m$, where $\tau_m$ is the shear stress where both models coincide. In this way, if the velocity of the fluid depends only on the coordinate z, we obtain different stationary Navier-Stokes equations for the fluid layers with different viscosities. The bi-viscosity model that we employ to approximate the HB shear-stress relation is, then, given by:

$$\begin{cases} \tau = -\tau_c + K\left(\frac{dv_z}{dr}\right)^n & \text{if } |\tau| > \tau_m \\ \tau = \eta_1 \frac{dv_z}{dr} & \text{if } |\tau| < \tau_m \end{cases} \tag{16}$$

where $\eta_1$ is a (fictitious) viscosity defined at low shears, and K is the consistency index for high shear and $-\tau_c$ is the intercept of the second model with the $\tau$ axis. The negative sign in front of $\tau_c$ is taken for convenience, since $v_z<0$ through the pipe and, consequently the shear stress will be negative everywhere. In the limit $\eta_1\rightarrow\infty$ both stresses tend to the yield stress: $\tau_c$, $\tau_m\rightarrow\tau_o$ and we recover Eq. (15).

In the central region of the pipe the shear stress is low and we can find $v^o$ by using the low stress ($|\tau|<\tau_m$) model and the Navier-Stokes equation of motion:

$$\eta_1\frac{dv_z^0}{dr}=\frac{r}{2}\frac{dp}{dz}+\frac{c_0}{r} \tag{17}$$

where dp/dz is the differential pressure along the pipe. At r=0 the gradient of the velocity is zero v=0 and then $c_0=0$. At the yield surface the stress $|\tau|=\tau_m$ and, then, the radius of the plug is given by:

$$r_o=\frac{2\tau_m}{dp/dz} \tag{18}$$

where $-\tau_m=\eta_1 dv_z^0/dr$. Integrating Eq. (16), the velocity in the plug region $r<r_0$:

$$v_z^0=\frac{r^2}{4\eta_1}\frac{\partial p}{\partial z}+c_1 \tag{19}$$

The computation of $c_1$ comprises several steps that are based on the continuity of the shear stress and the continuity of the velocity. First, notice that the region close to the pipe wall is subject to high shear $|\tau|>\tau_m$, and from Eq. (16) we find:

$$-K\left(-\frac{dv_Z^f}{dr}\right)^n=\tau_c-\frac{r}{2}\frac{dp}{dz}+\frac{c_2}{r} \tag{20}$$

Imposing continuity of shear stress at $r=r_0$ and using Eq. (16) leads to:

$$\eta_1\frac{dv_Z^0}{dr}=-\tau_c-K\left(-\frac{dv_Z^f}{dr}\right)^n \tag{21}$$

Replacing the left hand side by Eq. (17) and the second term of the right hand side by Eq. (20), $c_2=0$. Now, integrating Eq. (20) the velocity profile near the wall of the pipe is:

$$v_Z^f=\frac{2n}{(n+1)dp/dzK^{1/n}}\left[\left(-\frac{r}{2}\frac{dp}{dz}-\tau_c\right)^{\frac{n+1}{n}}-\left(-\frac{R}{2}\frac{dp}{dz}-\tau_c\right)^{\frac{n+1}{n}}\right] \tag{22}$$

which is valid in the region $r_0\leq r\leq R$, where R is the cylinder's radius.

Finally, by imposing continuity of velocity at $r=r_0$, $c_1$ is:

$$c_1=-\frac{r_0^2dp}{4\eta_1dz}+\frac{2n}{(n+1)K^{\frac{1}{2}}dp/dz}\left[\left(-\frac{r}{2}\frac{dp}{dz}-\tau_c\right)^{\frac{n+1}{n}}-\left(-\frac{R}{2}\frac{dp}{dz}-\tau_c\right)^{\frac{n+1}{n}}\right] \tag{23}$$

Thus, the velocity of the fluid in the plug region is:

$$v_Z^0=\frac{r^2-r_0^2}{4\eta_1}\frac{dp}{dz}+\frac{2n}{(n+1)dp/dzK^{1/n}}\left[\left(-\frac{r}{2}\frac{dp}{dz}-\tau_c\right)^{\frac{n+1}{n}}-\left(-\frac{R}{2}\frac{dp}{dz}-\tau_c\right)^{\frac{n+1}{n}}\right] \tag{24}$$

using Eq. (19).

In the limit $\eta_1\rightarrow\infty$, $\tau_m$, $\tau_c\rightarrow\tau_0$ and we find true plug velocity profile:

$$v_Z^0=\frac{2n}{(n+1)dp/dzK^{1/n}}\left(-\frac{r}{2}\frac{dp}{dz}-\tau_0\right)^{\frac{n+1}{n}} \tag{25}$$

where $v_z(R)=0$. This expression is valid in the region $0\leq r\leq r_0$.

To remove the pressure gradient from the velocity profile equations, the relation for the stress tensor in the fluid region, Eq. (2), together with $\tau_c=\tau_0$:

$$\tau=-\tau_0-K\left(-\frac{dv_Z^f}{dr}\right)^n=\frac{r}{2}\frac{dp}{dz} \tag{26}$$

From this expression for the shear stress, it is clear that it reduces from its maximum value at the wall to zero at the centerline. Thus, there is a region near the centerline within which the shear stress is less than the fluid's yield stress. This determines the "plug region," that is, an unyielding region formed near the center of the pipe where the fluid is transported as a plug.

The wall shear stress is given by $\tau|_{r=R}=-\tau_w$, then $$\tau_w=-\frac{D}{4}\left(\frac{dp}{dz}\right) \tag{27}$$

where D=2R is the pipe diameter. Finally, the velocity profiles in the fluid region, Eq. (22), and the velocity profile in the plug region are given by:

$$v_z^f=\frac{nD}{2(n+1)K^{1/n}\tau_w}\left[(\tau_w-\tau_0)^{\frac{n+1}{n}}-(-\tau(r)-\tau_0)^{\frac{n+1}{n}}\right] \tag{28}$$

$$v_z^0=\frac{nD}{2(n+1)K^{\frac{1}{n}}\tau_w}\left(-\frac{r}{2}\frac{dp}{dz}-\tau_0\right)^{\frac{n+1}{n}} \tag{29}$$

The governing equation for the volumetric flow rate, Q, is given by the surface integral of the velocity profile over the pipe:

$$Q=2\pi\int_S vdS=-2\pi\left[\int_0^{r_0}rv_z^0dr+\int_{r_0}^{R}rv_z^fdr\right] \tag{30}$$

where S is the cross-sectional vector surface, whose normal points outside the pipe. Integrating the above equation by parts leads to:

$$Q = 2\pi R^3 \frac{n}{z^{1/n}}\left(\frac{\tau_0}{K}\right)^{\frac{1}{n}}(1-z)^{(n+1)/n}\left[\frac{(1-z)^2}{3n+1} + 2z\frac{(1-z)}{2n+1} + \frac{z^2}{n+1}\right] \quad (31)$$

where $$z = \frac{\tau_0}{\tau_w} \quad (32)$$

In some embodiments, it may be assumed that all the volume of fluid is lost to one single fracture of cylindrical shape. We also consider laminar and established flow (the fluid completely fills the pipe) to model the fluid dynamics. In this way we can use simple geometrical relationships to relate the cross-section, length and volume of a cylinder. In other words, knowing the volume of fluid lost to fracture, we can infer the fracture's aperture and the penetration length of the fluid into the fracture. However, although these assumptions lead to a simple mathematical interpretation of the mechanisms of the losses, it does not have a direct physical interpretation. For example if the volume of the drill pipe is O(300) bbl at the moment of a total loss, then, L≈6 km, for a fracture of D=0.1 m. This example highlights the fact that this approach provides a high level description of the loss mechanisms. That is, there might be more than one fracture and/or the fracture might bifurcate into several channels or conduits of different aspect ratios. Hence, the aperture (entry point for wellbore losses) and length obtained with our model might be interpreted as the cumulative effect of the geometry of the underlying loss mechanism.

Hence, from Eq. (32):

$$z = \frac{2\tau_0}{|dp/dz|R} = \frac{2\tau_0}{|dp/dz|}\left(\frac{\pi L}{V}\right)^{1/2} \quad (33)$$

This may be the relationship used in a solver to estimate the fracture's geometry from z. Thus, to obtain the aperture of the fracture and the penetration length of the fluid, Eq. (17) is first solved to find z and, then, uses z to update the aperture and length in the iteration step via:

$$A = \pi R^2 = \pi\left(\frac{2\tau_0 L}{\Delta P z}\right)^2 \quad (34-1)$$

$$L = \frac{V}{\pi R^2} \quad (34-2)$$

$$= \left[\frac{z}{\tau_0}\frac{\Delta P}{2}\sqrt[2]{\frac{V}{\pi}}\right]^{3/2} \quad (34-3)$$

In some embodiments, the only quantity employed for the LCM recommendation approach may be the cross-section area A. In some embodiments, the length L may be used in the update step, as a constraint of the volume lost fracture.

In some embodiments, a numerical scheme may compute the aperture of the fracture. The scheme may first solve for z using Eq. (31), with fixed Q and ΔP, and subsequently, use the z found to estimate the aperture (radius) and penetration length of the fluid.

Once the radius of the fracture is obtained, a now flow condition from $\gamma=0\rightarrow\tau_w=\tau_0$ (see Eq. 32), to find the LCM penetration length $L_p$, and hence the volume needed to support a given design pressure $P_p$ and restore circulation:

$$1 = z = \frac{2\tau_0 L_p}{P_p R} \quad (35)$$

Rearranging terms and using the relation $L=V/(\pi R^2)$, the volume of product ($V_p$) used to plug the fracture may be:

$$V_p = \pi R^3 \frac{P_p}{2\tau_0} \quad (36)$$

Note that $P_p$ may be the minimum differential pressure required for shearing (flow) to occur. The total LCM volume predicted in Eq. (36), to prevent losses is representative of the LCM volume that we need to pump to seal the fracture and restore circulation. Note that $P_p$ may be selected such that drilling operations can continue with low risk of shearing the plug.

As an example, consider the following scenario: (a) while drilling, a wellbore enters total losses due to natural causes, assuming that the wellbore crosses significant fractures (e.g., a karst formation). (b) Subsequently, the drilling fluid sinks into the fracture, and the bottom hole pressure abruptly drops. (c) To mitigate the loss and reestablish fluid circulation in the well, a drilling operator to determine the volume of LCM product we need to bear a prescribed working pressure, $P_p$.

Following are numerical simulations for different loss circulation scenarios, corresponding to different flow rates, Q=[5, 10, 15] bbl/min, and pressure drop into the fracture ΔP=[10, 20, 50] psi. The HB parameters characterizing the drilling may be estimated from field-based mud readings, such as: R600/R300=56/40 and R6/R3=10/8, obtaining: K=0:02 [Pa][s]$^n$, $\tau_o$=11:28 [Pa] and n=0.97. From Eq. (36) it can be seen that, for a given fracture's aperture, the higher the $\tau_o$ the less product we will need to seal the fracture.

Figure 12:
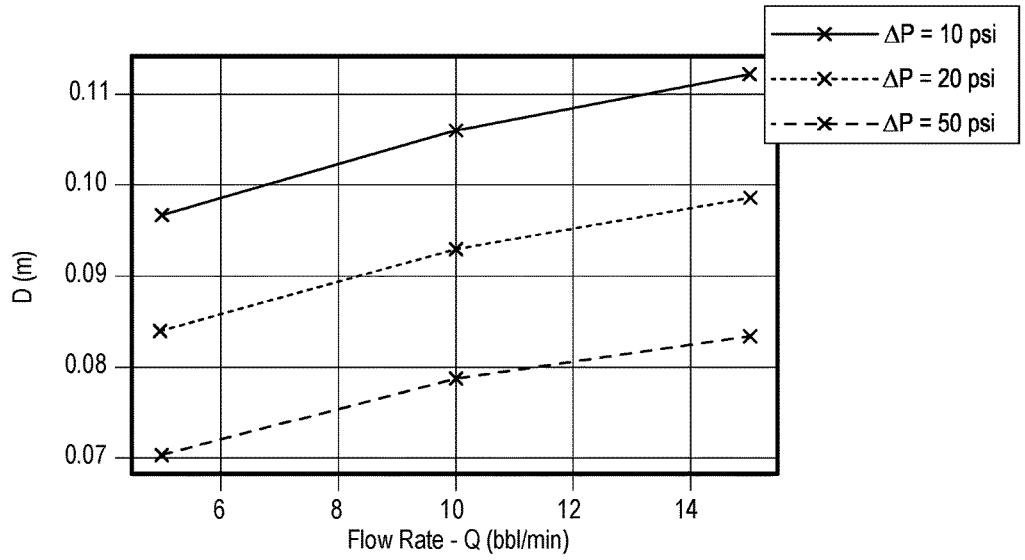
FIG. 12 is a representation of fracture diameter corresponding to different loss events, according to at least one embodiment of the present disclosure.
Figures 1, 13:
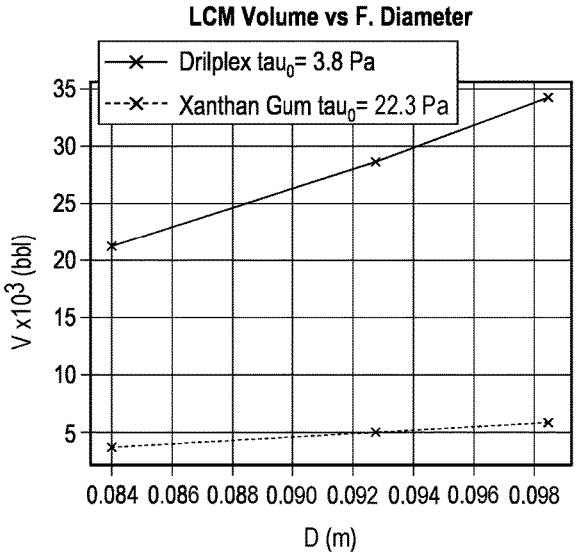
Figures 2, 13:
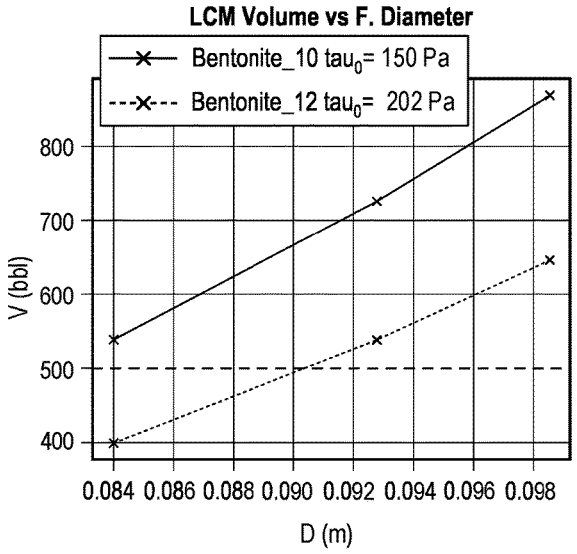
Figures 3, 13:
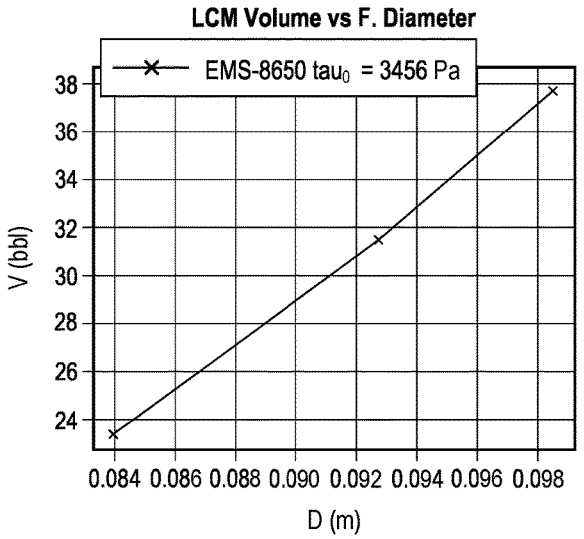
Figures 4, 13:
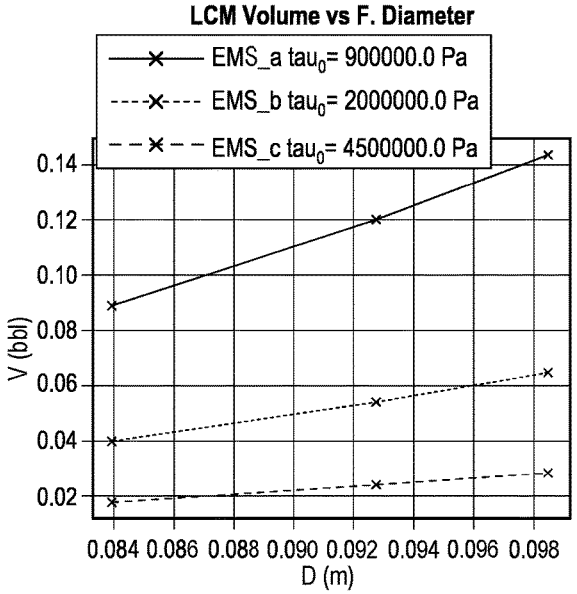
Figures 5, 13:
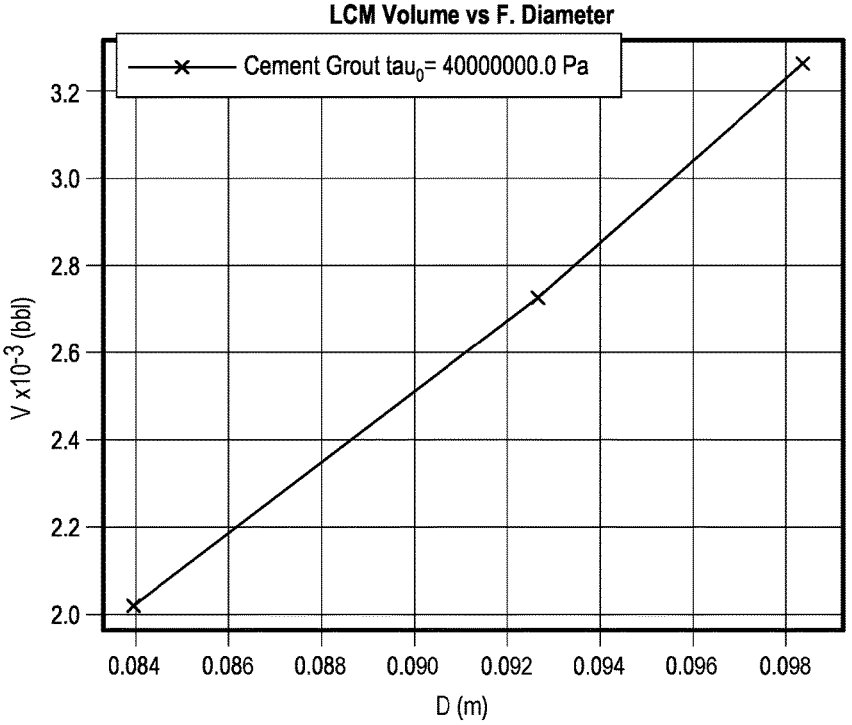

In FIG. 12, the fracture's aperture in different loss event scenarios has been computed, characterized by a flow-rate, Q, and a pressure drop, ΔP. As may be seen, for a given drilling fluid rheology, the estimated diameter is wider with increasing flow rates and lower for higher pressure drops. To compute volume estimates of LCM product, consider the range of apertures obtained with ΔP=20 psi, V=20 bbl, Q=[5, 10, 15] bbl/min. To determine whether a product is "pumpable" and, then, a good candidate to treat a given loss event, the drill string volume at the moment of the loss may be used as a reference volume, which for this example may be set to 500 bbl. Thus, volumes bigger than or similar to the drill string volume are discarded. FIGS. 13-1 to 13-5 are representations of the volumetric results where the horizontal red line in FIG. 13-2 corresponds to a hypothetical drill string volume; this sets a maximum volume of fluid that could be pumped to the restore circulation.

The present disclosure discusses various LC mitigation systems and approaches that may be used independently, or in any combination. Such approaches may also be used to estimate the volume of LCM to be used. For instance, a method may include extending the range of estimators for solids-based LCM into newer, gelled treatments. This may include the development of new loss control materials which may be developed independently of or through use of the approaches discussed herein. For instance, a bit-drop (MSE), hydraulic, or aperture approach may be used as an input to a LCM design process. As a result, methods and systems may include using multiple sources of aperture estimates, with LCM volume estimators, to determine the right volume of the right treatment or to propose alternatives such as sidetracking. Thus, while one may avoid preparing and pumping ineffective LCM treatments by determining the effective fracture/cavern width or diameter that is causing total mud losses, alternative methods may also be proposed. The fracture aperture diameter can be used to select the appropriate lost circulation mitigation technique. If LCMs are the appropriate lost circulation mitigation technique, the effective diameter may be further used to formulate the most effective LCM recipe and determine the proper volume of LCM to pump in order to plug the fracture/cavern and restore mud circulation.

The embodiments of the LC mitigation system have been primarily described with reference to wellbore drilling operations; the LC mitigation systems described herein may be used in applications other than the drilling of a wellbore. In other embodiments, LC mitigation systems according to the present disclosure may be used outside a wellbore or other downhole environment used for the exploration or production of natural resources. For instance, LC mitigation systems of the present disclosure may be used in a borehole used for placement of utility lines. Accordingly, the terms "wellbore," "borehole" and the like should not be interpreted to limit tools, systems, assemblies, or methods of the present disclosure to any particular industry, field, or environment.

In some embodiments, the methods of the present disclosure may be executed by a computing system. For instance, a computing system may include a computer or computer system that is an individual computer system or an arrangement of distributed computer systems. The computer system can include one or more analysis modules that are configured to perform various tasks according to some embodiments, such as one or more methods disclosed herein. Example modules or computing systems may be in the form of special-purpose downhole tools (e.g., sensor packages), or surface equipment. To perform these various tasks, the analysis module executes independently, or in coordination with, one or more processors, which are connected to one or more computer-readable media. The processors are optionally connected to a network interface to allow the computer system to communicate over a data network with one or more additional computer systems and/or cloud computing systems that may or may not share the same architecture, and may be located in different physical locations. For instance, one computer system may be located in downhole equipment, an alternative or additional computer system may be on a rig or wellbore surface, another may be in a maintenance/repair/mixing facility, another may be in a cloud-computing facility or data center, and any may be located in varying countries on different continents.

A processor may include a microprocessor, microcontroller, processor module or subsystem, programmable integrated circuit, programmable gate array, or another control or computing device. Additionally, while computer-readable media may be within a computer system, in some embodiments, computer-readable media may be distributed within and/or across multiple internal and/or external enclosures of a computing system and/or additional computing systems. The computer-readable media may be implemented as one or more computer-readable or machine-readable storage media, transmission media, or a combination of storage and transmission media.

As used herein, "storage media", "computer-readable storage media," and the like refer to physical media that stores software instructions in the form of computer-readable program code that allows performance of embodiments of the present disclosure. "Transmission media", "computer-readable transmission media," and the like refer to non-physical media which carry software instructions in the form of computer-readable program code that allows performance of embodiments of the present disclosure. Thus, by way of example, and not limitation, embodiments of the present disclosure can include at least two distinctly different kinds of computer-readable media, namely storage media and/or transmission media. Combinations of storage media and transmission media should be included within the scope of computer-readable media.

To further illustrate the distinct nature of storage media and transmission media, storage media may include one or more different forms of memory including semiconductor memory devices such as dynamic or static random access memories (DRAMs or SRAMs), erasable and programmable read-only memories (EPROMs), electrically erasable and programmable read-only memories (EEPROMs) and flash memories, magnetic disks such as fixed, floppy and removable disks, other magnetic media including tape, optical media such as compact disks (CDs) or digital video disks (DVDs), BLURAY® disks, or other types of optical storage, or solid state drives, or other types of storage devices.

Transmission media may conversely include communications networks or other data links that enable the transport of electronic data between computer systems and/or modules, engines, and/or other electronic devices. When information is transferred or provided over a communication network or another communications connection (either hardwired, wireless, or a combination of hardwired or wireless) to a computing device, the computing device properly views the connection as a transmission medium. Transmission media can therefore include a communication network and/or data links, carrier waves, wireless signals, and the like, which can be used to carry desired program, code means, or instructions.

Note that the instructions discussed above may be provided on one computer-readable or machine-readable medium, or may be provided on multiple computer-readable or machine-readable media distributed in a large system having possibly plural nodes. Such computer-readable or machine-readable medium or media is (are) considered to be part of an article (or article of manufacture). An article or article of manufacture may refer to any manufactured single component or multiple components. The computer-readable medium or media may be located either in the machine running the machine-readable instructions, or located at a remote site from which machine-readable instructions may be downloaded over a network for execution. Further, where transmission media is used, upon reaching various computing system components, program code in the form of computer-executable instructions or data structures can be transferred automatically or manually from transmission media to storage media (or vice versa). For example, computer-executable instructions or data structures received over a network or data link can be buffered in memory-type storage media (e.g., RAM) within a network interface module (NIC), and then eventually transferred to computer system RAM and/or to less volatile storage media (e.g., a hard drive) at a computer system. Thus, it should be understood that storage media can be included in computer system components that also (or even primarily) utilize transmission media.

It should be appreciated that described computing systems are merely examples of computing systems, and that a computing system may have more or fewer components than described, may combine additional components not described, or may have a different configuration or arrangement of the components. The various components of a computing system may be implemented in hardware, software, or a combination of both hardware and software, including one or more signal processing and/or application specific integrated circuits.

Further, the steps in the processing methods described herein may be implemented by running one or more functional modules in information processing apparatus such as general purpose processors or application specific chips, such as ASICs, FPGAs, PLDs, or other appropriate devices. These modules, combinations of these modules, and/or their combination with general hardware are included within the scope of the present disclosure.

Computational interpretations, models, and/or other interpretation aids may be refined in an iterative fashion; this concept is applicable to the methods discussed herein. This may include use of feedback loops executed on an algorithmic basis, such as at a computing device, and/or through manual control by a user who may make determinations regarding whether a given event, action, template, model, or set of charts has become sufficiently accurate for the evaluation of the frequency data under consideration.

One or more specific embodiments of the present disclosure are described herein. These described embodiments are examples of the presently disclosed techniques. Additionally, in an effort to provide a concise description of these embodiments, not all features of an actual embodiment may be described in the specification. It should be appreciated that in the development of any such actual implementation, as in any engineering or design project, numerous embodiment-specific decisions will be made to achieve the developers' specific goals, such as compliance with system-related and business-related constraints, which may vary from one embodiment to another. Moreover, it should be appreciated that such a development effort might be complex and time consuming, but would nevertheless be a routine undertaking of design, fabrication, and manufacture for those of ordinary skill having the benefit of this disclosure.

Additionally, it should be understood that references to "one embodiment" or "an embodiment" of the present disclosure are not intended to be interpreted as excluding the existence of additional embodiments that also incorporate the recited features. For example, any element described in relation to an embodiment herein may be combinable with any element of any other embodiment described herein. Numbers, percentages, ratios, or other values stated herein are intended to include that value, and also other values that are "about" or "approximately" the stated value, as would be appreciated by one of ordinary skill in the art encompassed by embodiments of the present disclosure. A stated value should therefore be interpreted broadly enough to encompass values that are at least close enough to the stated value to perform a desired function or achieve a desired result. The stated values include at least the variation to be expected in a suitable manufacturing or production process, and may include values that are within 5%, within 1%, within 0.1%, or within 0.01% of a stated value.

A person having ordinary skill in the art should realize in view of the present disclosure that equivalent constructions do not depart from the spirit and scope of the present disclosure, and that various changes, substitutions, and alterations may be made to embodiments disclosed herein without departing from the spirit and scope of the present disclosure. Equivalent constructions, including functional "means-plus-function" clauses are intended to cover the structures described herein as performing the recited function, including both structural equivalents that operate in the same manner, and equivalent structures that provide the same function. It is the express intention of the applicant not to invoke means-plus-function or other functional claiming for any claim except for those in which the words 'means for' appear together with an associated function. Each addition, deletion, and modification to the embodiments that falls within the meaning and scope of the claims is to be embraced by the claims.

The terms "approximately," "about," and "substantially" as used herein represent an amount close to the stated amount that is within standard manufacturing or process tolerances, or which still performs a desired function or achieves a desired result. For example, the terms "approximately," "about," and "substantially" may refer to an amount that is within less than 5% of, within less than 1% of, within less than 0.1% of, and within less than 0.01% of a stated amount. Further, it should be understood that any directions or reference frames in the preceding description are merely relative directions or movements. For example, any references to "up" and "down" or "above" or "below" are merely descriptive of the relative position or movement of the related elements.

All appendices included herewith and all external references cited herein are incorporated by this reference in their entirety and form part of the full disclosure herein.

The present disclosure may be embodied in other specific forms without departing from its spirit or characteristics. The described embodiments are to be considered as illustrative and not restrictive. The scope of the disclosure is, therefore, indicated by the appended claims rather than by the foregoing description. Changes that come within the meaning and range of equivalency of the claims are to be embraced within their scope.

What is claimed is:

1. A method for mitigating a lost circulation event in a wellbore, comprising:

obtaining at least one drilling parameter selected from the group consisting of: surface flow rate, drilling fluid volume, drilling fluid pressure, or drilling fluid rheology;

modeling a fracture aperture in a subterranean formation based on the obtained at least one drilling parameter, wherein the modeling determines i) a radius of the fracture aperture and ii) a fluid penetration length by solving equations that represent fluid flow in the wellbore that includes a plug region around a center of the wellbore and non-plug region near a wall of the wellbore; and performing a force balance to determine a volume of lost circulation material (LCM) for plugging the fracture aperture from the radius of the fracture aperture of i), the fluid penetration length of ii), a yield stress of the LCM, and a target overpressure to restore circulation, wherein determining the volume of LCM includes discarding candidate volumes of LCM that are greater than or equal to a reference drill string volume determined at a time of the lost circulation event.

2. The method of claim 1, wherein the drilling fluid rheology is different from a lost circulation material (LCM) rheology.

3. The method of claim 1, further comprising designing the LCM based on the radius of the fracture aperture of i).

4. The method of claim 1, further comprising:

applying a lost circulation mitigation technique in the wellbore, wherein the lost circulation mitigation technique pumps the volume of LCM into the wellbore for plugging the fracture aperture.

5. The method of claim 1, further comprising:

applying a lost circulation mitigation technique in the wellbore, wherein the lost circulation mitigation technique involves plugging the well.

6. The method of claim 1, further comprising:

applying a lost circulation mitigation technique in the wellbore, wherein the lost circulation mitigation technique involves sidetracking.

7. The method of claim 1, further comprising:

applying a lost circulation mitigation technique in the wellbore, wherein the lost circulation mitigation technique involves blind drilling.

8. The method of claim 1, further comprising:

applying a lost circulation mitigation technique in the wellbore, wherein the lost circulation mitigation technique involves casing drilling or liner drilling.

9. The method of claim 1, further comprising:

applying a lost circulation mitigation technique in the wellbore, wherein the lost circulation mitigation technique involves managed pressure drilling.

10. The method of claim 1, wherein the equations that represent fluid flow in the wellbore equate volumetric flow rate within the wellbore to terms that represent an integral of the velocity profile over both the plug region and the non-plug region.

11. The method of claim 1, wherein the modeling assumes that all volume of fluid lost in the lost circulation event arises from one single fracture of cylindrical shape.

12. The method of claim 11, wherein the radius of the fracture aperture of i) and the fluid penetration length of ii) represent a cumulative effect of more than one fracture or a fracture that bifurcates into several channels or conduits of different aspect ratios.

13. The method of claim 1, wherein the equations that represent fluid flow in the wellbore are based on a Hershel-Bulkley rheological fluid model that employs a first shear-stress relation for the plug region and a second shear-stress relation for the non-plug region.

14. The method of claim 13, wherein the first shear-stress relation is based on a viscosity defined at low shears, and the second shear-stress relation is based on a consistency index for high shear, a rate of shear of the fluid, and a flow behavior index.

* * * * *